United States Patent [19]

Daboub

[11] Patent Number: 4,884,796

[45] Date of Patent: Dec. 5, 1989

[54] SINGULATOR FOR DOCUMENT FEEDER

[76] Inventor: Henry A. Daboub, 1420 Grand Teton, DeSoto, Tex. 75115

[21] Appl. No.: 198,871

[22] Filed: May 26, 1988

[51] Int. Cl.[4] ..... B65H 3/06

[52] U.S. Cl. ..... 271/111; 271/105; 271/118; 271/126; 271/150; 271/114

[58] Field of Search ..... 271/105, 30.1, 31, 117, 271/118, 126, 149, 150, 162, 110, 111, 149, 150, 114, 110, 111, 122

[56] References Cited

U.S. PATENT DOCUMENTS

| | | | |
|---|---|---|---|
| 2,762,623 | 9/1956 | Uthenwoldt . | |
| 3,044,770 | 7/1962 | Breuers . | |
| 3,411,768 | 11/1968 | Gatti | 271/117 X |
| 3,825,248 | 7/1974 | Friend . | |
| 4,030,722 | 6/1977 | Irvine . | |
| 4,032,135 | 6/1977 | Ruenzi . | |
| 4,039,180 | 8/1977 | Stocker . | |
| 4,083,555 | 4/1978 | Irvine . | |
| 4,273,322 | 6/1981 | Ginther | 271/149 |
| 4,303,234 | 12/1981 | Plum . | |
| 4,522,385 | 6/1985 | Stefansson . | |
| 4,529,187 | 7/1985 | Einem . | |
| 4,638,987 | 1/1987 | Sakurai . | |
| 4,666,144 | 5/1987 | Silverberg . | |
| 4,695,171 | 9/1987 | Sapitowicz . | |

FOREIGN PATENT DOCUMENTS

| | | | |
|---|---|---|---|
| 1151283 | 5/1969 | United Kingdom | 271/126 |

OTHER PUBLICATIONS

IBM Technical Disclosure Bulletin, Vol. 14, No. 5, pp. 1534, 1535, October, 1971, "Cut Sheet Feed Device", J. C. Rogers.

*Primary Examiner*—Richard A. Schacher
*Attorney, Agent, or Firm*—Drude Faulconer

[57] ABSTRACT

A feeder for document processing equipment having a singulator for feeding a single document upon demand. The feeder includes a movable gate which when in a closed position acts as a fixed guide for properly aligning a stack of documents in a magazine and which when in a released position moves out of contact with the documents to relieve the frictional force between documents. The gate is moved to its released position simultaneously with the start of the pick-off means of the singulator whereby the frictional force between the first and second document is substantially reduced at the instance the first document is picked off the stack.

11 Claims, 2 Drawing Sheets

SINGULATOR FOR DOCUMENT FEEDER

DESCRIPTION

1. Technical Field

The present invention relates generally to a document feeder and in one of its preferred aspects to a document feeder which includes a singulator having a movable feeder gate for reducing frictional contact between documents in a stack just as the first document is picked off from the stack.

2. Background Art

In recent years, automated equipment has been developed for processing large volumes of documents (e.g., letters, postcards, checks, etc.). For example, equipment is currently available which takes stacks of envelopes and/or postcards and feeds them individually to a viewing station where an operator reads the address and operates a keyboard to input a code which is representative of the address or other information on the envelope. When the entry is complete, a print means is activated to print indicia (bar code) on the envelope that corresponds to the address. Envelopes from one or more operators are then run through high speed sorters which electronically read the codes and all envelopes having the same code are directed to a particular stacker bin or pocket.

For such document processing equipment to operate at its maximum efficiency, the documents must be fed one at a time upon demand with "double" or multiple feeds held to a minumum. That is, if more than one document is fed into the equipment at the same time, several problems are likely to arise, e.g., jamming of documents, failure to properly process all of the documents, etc. Therefore, the document feeder for such equipment must be capable of picking-off a single document from a stack and then feeding only that document into the equipment for individual processing.

There are several known singulators which have been proposed for this purpose. Some of these operate continuously to feed a steady supply of single documents through the equipment while others operate to feed a single document on demand. For example, U.S. Pat. Nos. 4,030,722 and 4,038,555 disclose singulators for high speed sheet feeders. In U.S. Pat. Nos. 3,825,248 and 4,522,385, continuous singulators are disclosed having rollers which are driven at progressively increasing speeds to advance sheets individually while a reverse driven roller prevents additional documents from being fed therewith. Examples of other types of similar singulators are disclosed in U.S. Pat. Nos. 3,044,770; 4,032,135; 4,039,180; 4,529,187; 4,303,234; and 4,638,987.

While all of the above singulators appear to be sound in concept, all essentially utilize a fixed guide in some form against which a stack of documents is fed to align the first document on the stack with the pick-off means of the singulator. By feeding the documents against a fixed guide, the stack is inherently "compressed: that is, the documents are forced into firm contact with each other and considerable frictional force exists therebetween. Accordingly, when the pick-off means is actuated, the frictional force between documents tends to pull the second document in the stack along with the first document thereby substantially increasing the possibility of a double feed even in those instances where additional means, e.g., reverse-driven rollers, etc., are present in the singulator to prevent this from happening.

Since the feeding of "doubles", even if only occasionally, seriously affects the overall efficiency of the processing equipment, it is vitally important that singulators for such equipment are as near perfect in this respect as is possible. Accordingly, it follows that any reduction in frictional contact between documents at the time a document is picked off a stack will be highly beneficial in preventing multiple feeds from occurring.

DISCLOSURE OF THE INVENTION

The present invention in a preferred aspect provides a feeder for document processing equipment having a singulator for feeding a single document upon demand into the processing equipment. The feeder includes a movable gate which when in a closed position acts as a fixed guide for properly aligning a stack of documents in a magazine and which when in a released position moves out of contact with the documents to thereby relieve the frictional force between the documents. The gate is moved to its released position simultaneously with the start of the pick-off means of the singulator whereby the frictional force between the first and second document is substantially reduced at the instance the first document is picked-off the stack.

More specifically, the present document feeder is comprised of a magazine which is adapted to receive a stack of documents. A movable feed gate is positioned at the front of the magazine and is aligned with a pick-off roller of a pick-off means. Conveyor belts or the like feed the stack of documents forward in the magazine until the first document is forced into contact with both the feeder gate and the pick-off roller. The pick-off roller is mounted on an arm which actuates a switch to stop the conveyor when the pressure of the compressed documents on the pick-off roller exceed a predetermined shut off pressure.

On a signal from the operator, the feeder gate is simultaneously moved to a released position out of contact with the document as the pick-off roller begins to rotate in a forward direction. As the gate moves out of contact with the compressed stack of documents, the first document and those behind it are free to decompress thereby substantially reducing the frictional contact therebetween. This allows the pick-off roller to more easily pick off only the first document from the front of the stack thereby substantially reducing the possibility that additional documents will be fed along with the first document due to the friction therebetween.

The pick-off means further includes a second roller that is driven simultaneously with the pick-off roller in a forward direction. A third roller forms a nip with the second roller and is driven through a slip clutch which allows the third roller to be driven in a forward direction when the third roller is in contact with said second roller or is in contact with a single document in the nip but allows the third roller to be driven in a reverse direction when the third roller contacts any additional documents that may be attempting to pass through said nip with the single document to thereby drive the additional document in a reverse direction from that of the single document.

A sensor, e.g., photocell, is positioned to sense the leading edge of the single document just as it passes through the nip between the second and third rollers to generate a signal which stops the pick-off means and which moves the feed gate back to its closed position where it is in contact with the stack of documents in the magazine.

A take-off roller is positioned adjacent the nip between the second and third rollers and is continuously rotated in a forward direction. A pinch means is actuated at the same time the pick-off means is actuated to form a nip with the take-off roller whereby any document in the nip between the second and third rollers is put into "pinch" with the take-off roller and is thereby advanced forward into the document processing equipment.

BRIEF DESCRIPTION OF THE DRAWINGS

The actual construction, operation, and the apparent advantages of the present invention will be better understood by referring to the drawings in which the numerals identify like parts and in which.

BEST MODE FOR CARRYING OUT THE INVENTION

Figure 1:
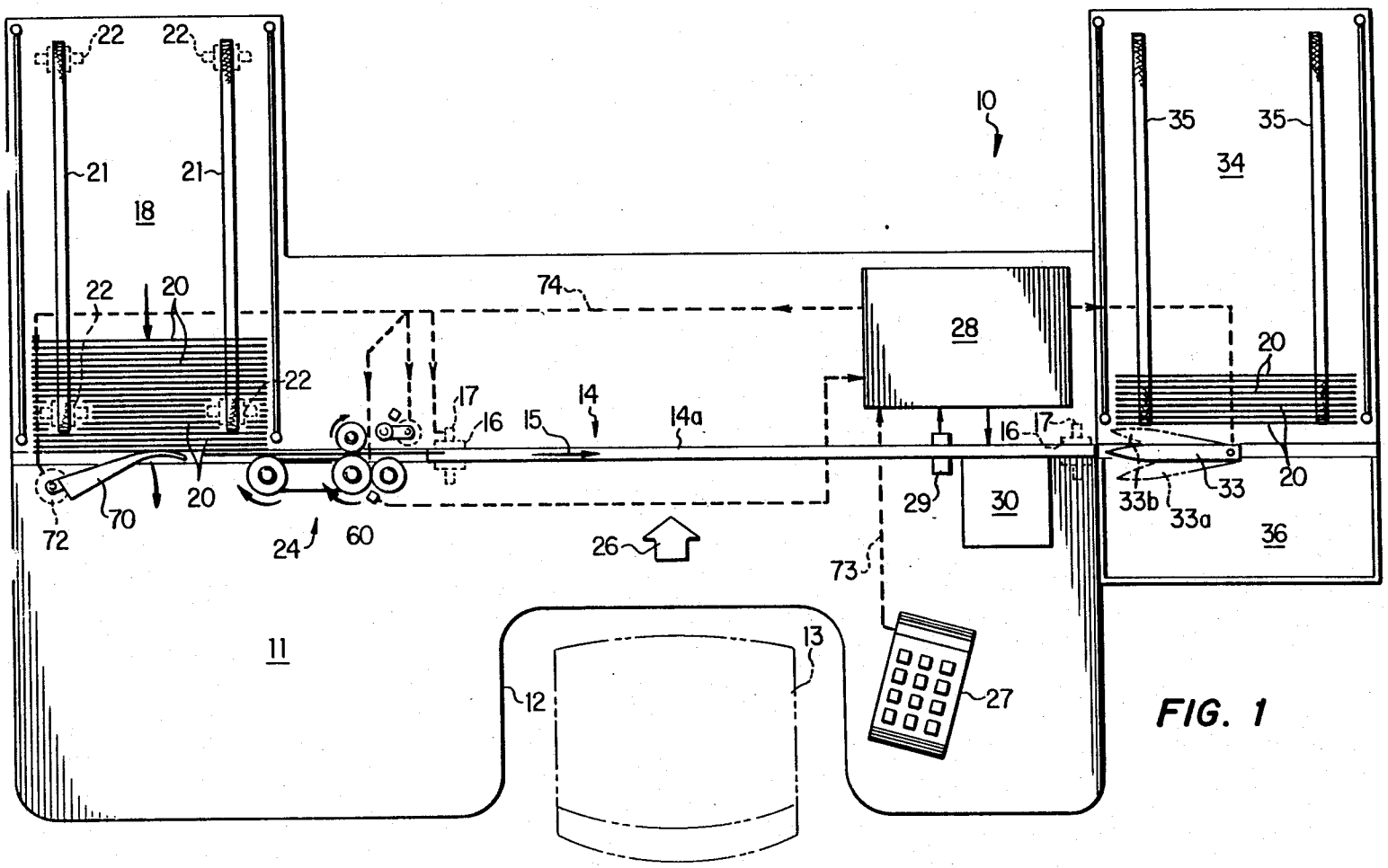
FIG. 1 is a plan view of document processing equipment incorporating the document feeder of the present invention.

Referring more particularly to the drawings, FIG. 1 is a plan view of a typical code desk 10 which is used to print codes onto envelopes so they can then be handled by automated sorting equipment. As shown, code desk 10 is comprised of a desk top 11 having a recess 12 therein at which an operator (not shown) sits in chair 13. Transport 14 runs along the back of top 11 and is comprised of a flat continuous belt 14*a* that is moved in the direction shown by arrow 15 by pulleys 16 mounted on drive shafts 17. Magazine 18 opens onto transport 14 and is adapted to receive a stack of envelopes 20 which is moved forward in magazine by a conveyor, e.g., pair of continuous belts or chains 21 mounted on pulleys 22. As envelopes 20 are moved forward, they are picked off one-by-one "on-demand" by singulator 24 of the present invention and are placed on belt 14*a* of transport 14 which, in turn, moves and stops individual envelopes 20 at viewing station 26 in front of an operator, as will be explained in detail below.

The operator reads the address or other information on the envelope and enters a code corresponding thereto into encoding means 27, e.g., standard keyboard or keypad, which, in turn, inputs a corresponding print signal to a dedicated CPU 28, e.g., Apple II computer. When entry is completed and entered (e.g., Enter button is pushed on means 27), transport 14 is activated to move the envelope 20 which is in front of the operator down the transport and another envelope is picked off by singulator 24 and is moved to station 26. Photocell 29 generates a signal when the leading edge of the envelope is detected to call the print signal from the CPU 28 and to instruct print means 30 to print the desired code on the envelope. Preferably, print means 30 is a ink jet printer capable of printing a bar code, e.g., Model 80-I, distributed by Siemens, Munich, West Germany; although other print means can be used without departing from the present invention.

The envelope continues past print means 30 on transport 14. Diverter 33 is actuated to position 33*a* to divert envelope 20 into stacker pocket 34 which has take-away belts or chains 35 to move the stacked envelopes back into pocket 34. If the envelope has no code or is otherwise deficient, the operator can hit a reject key on means 27 whereby no code is printed and diverter 33 is moved to the position 33*b* to deflect the defective envelope into reject pocket 36 (e.g., basket). The equipment as described to this point with the exception of singulator 24 is well known and is commercially available, e.g., NPI Model MC-2000 Code Desk, manufactured by National Presort, Inc., Dallas, Tex.

Singulator 24 of the present invention provides a document feeder which picks off a single letter 20*a* on demand and delivers it to an operator while physically preventing multiple documents from being fed therewith. While singulator 24 is described herein in connection with the code desk 10 of FIG. 1, it should be understood that it could be used equally as well with other document processing equipment which require a functionally equivalent singulator.

Figure 2:
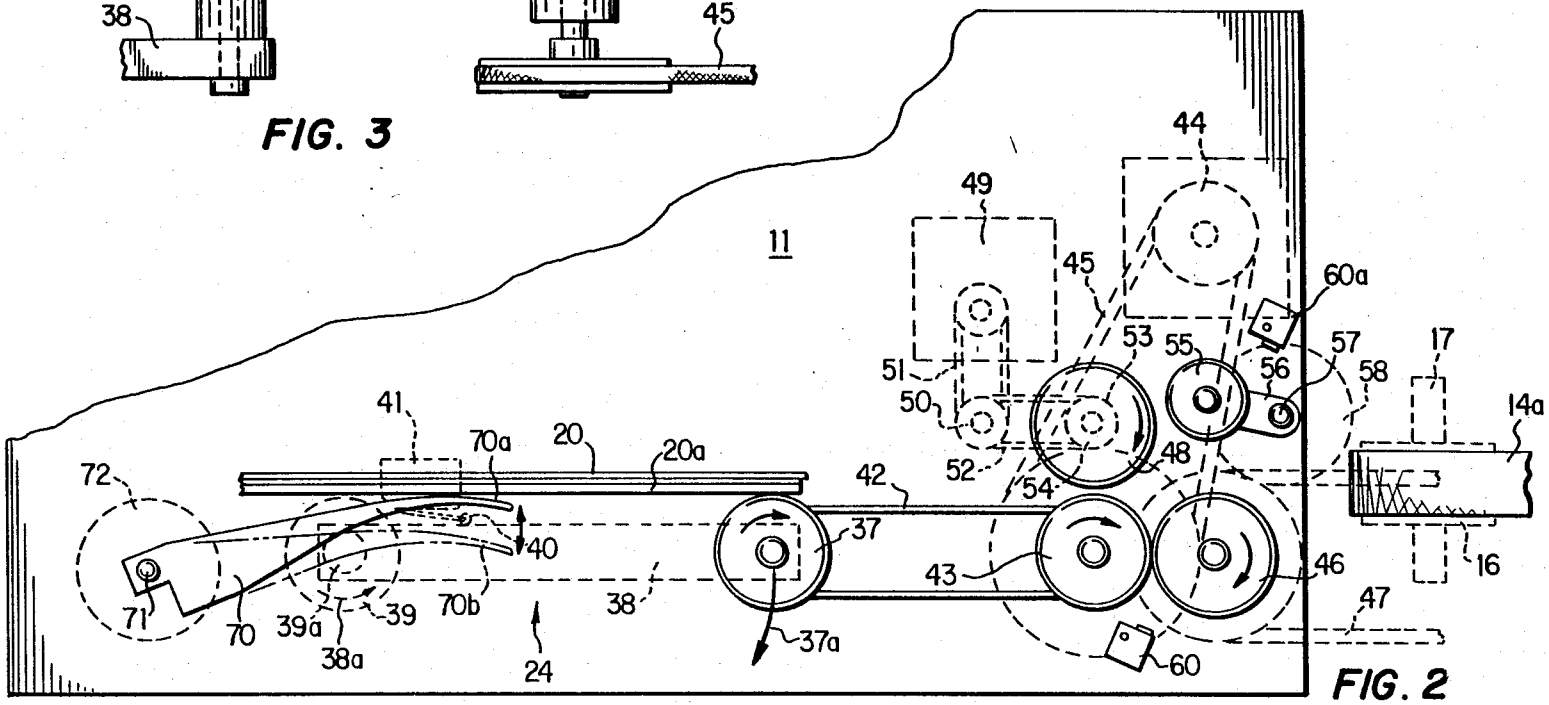
FIG. 2 is an enlarged plan view of the singulator of the document feeder of FIG. 1.

Referring now to FIGS. 1 and 2, singulator 24 is comprised of a primary pick-off roller 37 which is journaled for rotation on one end of arm 38. The other end of arm 38 is journaled in fixed-bearing block 39 so that arm 38 can rotate in a horizontal plane about pivot 39*a*. A spring or the like (not shown) is associated with pivot 39*a* to bias arm 38 in the direction of arrow 38*a*. Contact 40 of switch means 41, e.g., microswitch, is positioned to contact arm 38 and to turn switch on or off as arm 38 rotates in different directions about pivot 39*a*. Switch 41, in turn, turns the motor (not shown) which operates feed chains 21 on and off. Accordingly, when switch 41 is on, chains 21 will continue to move letters 20 forward until the first letter 20*a* contacts pick-off roller 37. Continued movement of the letters causes arm 38 to rotate about pivot 39*a* in the direction of arrow 37*a* (FIG. 2) and against the bias of 39*a* thereby causing contact 40 of on-off switch 41 (e.g., Model 2TMA-4, Unimax Switch, Wallingford, Conn.) to move to an "off" position thereby stopping chains 21 and hence, the forward movement of letters 20.

As letters 20 are picked-off by roller 37, as will be explained below, the pressure exerted by letters 20 on roller 37 is relaxed so that arm 38 is now rotated in the opposite direction by bias 38*a* which allows switch 41 to move to an "on" position whereupon chains 21 again feed letters 20 forward into contact with roller 37 and the sequence is repeated. Bias 38*a* is carefully adjusted to allow arm 38 to be moved under only slight pressure on roller 37 but, at the same time, is such that arm 38 is quickly and reliably returned to its original position when the pressure on roller 37 is only slightly relaxed. This insures that letters 20 will be properly fed forward into contact with primary pick-off roller 37 at all times during operation of singulator 24.

Figure 3:
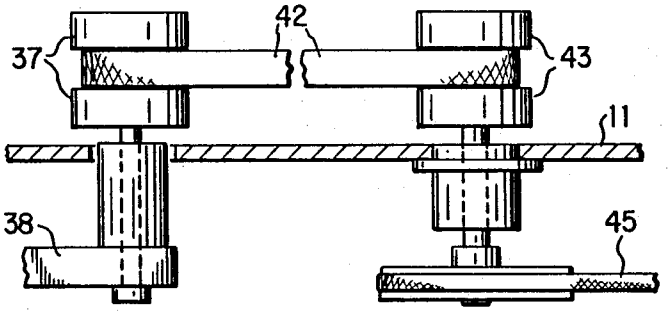
FIG. 3 is a sectional view taken along line 3—3 of FIG. 2.

As best seen in FIG. 3, pick-off roller 37 has an intermediate recess (may be formed by two spaced roller on the same shaft) therein adapted to receive drive belt 42 which, in turn, is driven by a second roller 43, which in turn, is driven by motor 44 via belt 45 (FIG. 2). Take-off roller 46 is aligned with but does not contact second roller 43 and is continuously rotated in a forward direction by belt 47 from a drive motor (not shown). A third roller 48 is mounted so that it is normally biased into engagement with second roller 43 and can undergo limited movement towards and away from roller 43. To compensate for this movement, motor 49 drives a fixed, intermediate double-grooved pulley 50 via belt 51 and pulley 50 in turn, drives pulley 53 via belt 52. It can be seen that as the axis of roller 53 moves in an arc about fixed pulley 50, belts 51 and 52 will remain taut and will continue to smoothly drive third roller 48 in a reverse direction in respect to the other rollers previously described.

Third roller 48 is connected to drive pulley 53 through a friction or "slip" clutch 54, e.g., Model GM-B-302, Machine Components, Plainview, N.Y., which is set at a tension, e.g., 5 ounces, which allows roller 48 to slip on its shaft and be rotated in a forward direction by forward-driven, second roller 43 when in contact therewith but will provide a driving connection between roller 48 and its shaft when roller 48 is out of direct contact with roller 43 so that motor 49 will continuously rotate roller 48 in a reverse direction for a purpose described below.

Idler roller 55 is journaled for rotation on one end of arm 56 which, in turn, has its other end fixed to the output shaft 57 of actuator 58. Preferably, actuator 58 is comprised of a rotational solenoid which, when actuated, rotates shaft 57 in one direction against the bias of an internal spring (not shown) which, in turn, rotates shaft 57 in the opposite direction back to its original position when the solenoid is deactuated. An example of such a commercially-available solenoid is Model 188131-00 (Right-hand or Left-hand), manufactured by Ledex, Inc., Vandalia, Ohio. Photocell 60, **60*a* is positioned as shown in FIG. 2 to sense the leading edge of a letter just as it moves adjacent with third roller 46. The purpose for idler roller 55 and photocell 60, 60*a* will become obvious in the description of the operation of singulator 24** set forth below.

An important aspect of present singulator 24 is feeder gate 70 which, in effect, acts as a "moveable" stop or guide for letters 20 as they are fed forward against pick-off roller 37. Gate 70 is mounted on shaft 71 of actuator 72, (e.g., a rotational solenoid such as described above). When actuator 72 is in a deactuated position, gate 70 is normally biased to a closed position (**70*a* in FIG. 2) where it is in firm contact with letters 20. When actuator 72 is actuated, shaft 71 rotates gate 70 to its release position 70*b*. Now that the details of the structural components of singulator 24** have been set forth, the operation thereof is as follows.

Letters 20 are fed forward in magazine 18 until pressure on primary pick-off roller actuates switch 40 to stop feed chains 21 as fully described above. At this time, the first letter **20*a* is in firm contact with feeder gate 70 which is stationary in its closed position 70*a*. Gate 70 while in this position acts basically as a fixed guide or stop to align the letters for pick-off roller 37 and to keep the stack of letters upright in magazine 18. An operator inputs the desired information and hits the "Enter" key or equivalent on keypad 27 thereby transmitting (1) a signal representative of the inputted information to CPU 28 via dotted line 73 (2) a "go" or start signal. Upon receipt of the "go" signal, CPU 28 outputs command signals simultaneously through appropriate lead(s) (represented by dotted lines 74 in FIG. 1) to (1) actuator 72; (2) motor 44 which drives both pick-off roller 37 and second roller 43; (3) actuator 58; and (4) to the motor (not shown) for driving transport pulley 16. As pick-off roller 37 begins rotating in a forward direction to physically pull first letter 20*a* forward off of the front of the stack of letters 20, actuator 72 rotates feeder gate 70 from its closed position 70*a* to its released position 70*b*. Since feeder chains have "compressed" the letters against gate 70 and against each other before switch 41 is turned off, when gate 70 is suddenly moved out of contact with the stack of letters, first letter 20*a* and those immediately behind it are now free to "decompress" but each letter does so at a substantially and successively slower rate than that at which gate 70 moves. This "expanding bellows" effect substantially reduces the frictional contact between the first and second letters in the stack which, in turn, allows pick-off roller 37 to pick-off only first letter 20*a* or, at the very least, allows letter 20*a* to move a substantial distance before the second letter establishes sufficient frictional contact with letter 20*a* to be moved therewith which aids in preventing the second letter from being fed with first letter 20*a*** into the processing equipment as will be explained below.

Letter **20*a* is taken from the stack and pushed by pick-off roller 37 into contact with second roller 43 which pulls it through the nip between rollers 43, 48 until the leading edge of the letter breaks the light beam of photocell 60, 60*a*. Photocell 60 then sends a "stop" signal to CPU 28 which, in turn, relays signals to stop (1) motor 44, hence rollers 37, 43; (2) transport 14*a*; and to deactuate (3) actuator 72 which allows feeder gate 70 to return to its closed position 70*a*; and (4) actuator 58, the purpose of the latter being as follows. If a previous sequence has placed a letter just through the nip of rollers 43, 48 and adjacent photocell 60, upon input of the "go" signal, actuator 58 is actuated as mentioned above. Actuator 58 will rotate arm 56, hence idler roller 55, toward continuously forward-rotating, take-off roller 46. Idler roller 55 forces any letter that is being moved forward by roller 43 into "pinch" with roller 46 whereby the letter will be pulled forward thereby to be deposited onto transport 14*a* which, in turn, will deliver the letter to the viewing station 26 in front of the operator. A "stop" signal from photocell 60 deactuates actuator 58 and the internal bias therein moves idler 55** back to its original position to await the next "on-demand" Z sequence.

Of course, during any one sequence, any letter in front of the operator at the start of the sequence will be moved by transport 14 past printer 30 where the input code is printed thereon and on into either pocket 34, 36 as the case may be.

As mentioned above, reverse driven roller 48 is coupled to its drive pulley 53 by a slip clutch 54 which is set to slip when roller 48 is in effective contact with roller 43 (i.e. when roller 48 is in rubber-to-rubber contact with forward driven roller 43 or when a single document is in the nip between the rollers). That is, roller 48 will override the clutch and will be driven in a forward direction as a single letter passes through the nip. However, when a second letter is "dragged" along with first letter **20*a* into the nip due to frictional contact between the letters, the second letter is engaged by roller 48 and the "paper-to-paper" frictional contact between letters is such that clutch 54 will now allow roller 48 to be rotated in a reverse direction to thereby drive the second letter backwards This allows only the first letter 20*a*** to be driven forward through the nip between the rollers.

What is claimed is:

1. A singulator for feeding single documents from a stack of documents, said singulator comprising:

a movable feeder gate;

means for moving said feeder gate between closed and released position, said feeder gate normally being in a closed position;

a pick-off means for picking off documents one at a time from said stack of documents, said pick-off means comprises:

roller means for engaging the first document of said stack of documents;

means for driving said roller means in a forward direction upon demand to remove said first document in contact therewith, and means for engaging any additional documents removed with said first document to prevent movement of said any additional documents with said first document;

means for feeding said stack of documents into contact with said pick-off means and said gate when said gate is in said closed position; and means for simultaneously moving said gate to said released position and for actuating said pick-off means whereby the compression of said stack of documents is relaxed as pick-off means removes the first document from said stack.

2. The singulator of claim 1 wherein said means for moving said feeder gate comprises:

a rotary solenoid.

3. The singulator of claim 1 including:

means to move said feeder gate to said closed position when said pick-off means is deactuated.

4. The singulator of claim 5 including:

a take-off roller adapted to engage said first document as it is fed forward by said pick-off to advance same.

5. The singulator of claim 1 wherein said means for engaging any additional documents comprises:

a roller driven in a reverse direction, adapted to engage said any additional documents removed with said first document to move said any additional documents in a direction opposite to that of said first document.

6. A document feeder comprising:

a magazine adapted to receive a stack of documents;

a movable gate positioned at the front of said magazine;

a pick-off roller aligned with said gate at said front of said magazine;

a second roller aligned with and spaced from said pick-off roller;

means for simultaneously driving said pick-off roller and said second roller in a forward direction;

a third roller normally in contact with said roller to form a nip therebetween; said third roller including a slip clutch which is adapted to slip when said third roller is in contact with said second roller or is in contact with a single document passing through said nip between said second and third rollers and to be engaged when two or more documents are in said nip;

a conveyor adapted to engage said stack of documents to move said stack forward into contact with said gate and said pick-off roller;

drive means for driving said conveyor;

stop means for stopping said drive means when the pressure of said stack of documents on said pick-off roller exceeds a predetermined pressure;

means for simultaneously (a) moving said gate out of contact with said first document and (b) actuating said pick-off means; and sensor means to simultaneously stop (a) said pickoff and second rollers and (b) close said movable gate when said first document reaches said nip between said second and third rollers.

7. The document feeder of claim 6 wherein said sensor means comprises:

a photocell positioned to sense the leading edge of said first document as it passes through said nip between said second and third rollers.

8. The document feeder of claims 6 wherein said pick-off means further includes:

a take-off roller aligned with said third roller;

means for continuously rotating said take-off roller in a forward direction;

pinch means; and means for moving said pinch means toward said take-off roller to form a nip therebetween when said first document is adjacent said take-off roller whereby said first document is moved forward by said take-off roller.

9. The document feeder of claim 8 wherein said pinch means comprises:

an idler roller; and an actuator for moving said idler roller toward said take-off roller to form a nip therebetween.

10. The document feeder of claim 9 wherein said actuator comprises:

a rotary solenoid.

11. The document feeder of claim 6 wherein stop means comprises:

an arm having said pick-off roller journaled thereon, said arm being mounted for rotational movement and normally biasing pick-off roller toward said stack of documents in said magazine; and a switch actuated by said arm wherein movement of said pick-off roller away from said stack of documents moves said switch to an off position and movement of said pick-off roller towards said stack of documents moves said switch to an on position.

* * * * *